US005772136A

United States Patent [19]

Gilbos et al.

[11] Patent Number: 5,772,136

[45] Date of Patent: Jun. 30, 1998

[54] AUTOMATIC ASSEMBLY MACHINE FOR YARNS

[75] Inventors: Erik Gilbos, Dikkelvenne; Emiel Rubbrecht, Iddergem; Christian Van Hautte, Wannegem-Lede; Tom Jacobs, Dendermonde, all of Belgium

[73] Assignee: Textielmachinefabriek Gilbos N.V., Belgium

[21] Appl. No.: 729,209

[22] Filed: Oct. 15, 1996

[30] Foreign Application Priority Data

Oct. 16, 1995 [BE] Belgium ..... 9500862

[51] Int. Cl.[6] ..... D01H 13/26; B65H 69/00; B65H 63/02

[52] U.S. Cl. ..... 242/42; 242/35.6 E; 242/38; 57/22; 57/261; 57/264; 57/333

[58] Field of Search ..... 57/264, 22, 328, 57/333, 261, 279, 286; 242/38, 42, 35.6 E

[56] References Cited

U.S. PATENT DOCUMENTS

| | | | |
|---|---|---|---|
| 3,792,821 | 2/1974 | Fallon | 242/38 X |
| 3,794,252 | 2/1974 | Abbott | 242/38 |
| 3,844,497 | 10/1974 | Harrill et al. | 242/38 X |
| 4,556,176 | 12/1985 | Miller | 242/38 |
| 4,943,009 | 7/1990 | Gerstner-Stevens et al. | 242/38 X |
| 4,947,633 | 8/1990 | Stahlecker | 242/38 X |
| 5,044,150 | 9/1991 | Stahlecker | 242/38 X |

FOREIGN PATENT DOCUMENTS

| | | | |
|---|---|---|---|
| 1121866 | 8/1956 | France | 242/38 |
| 171973 | 9/1985 | Japan | 242/38 |
| 363274 | 8/1962 | Switzerland | 242/38 |

*Primary Examiner*—C. D. Crowder
*Assistant Examiner*—Tina R. Taylor
*Attorney, Agent, or Firm*—William A. Drucker

[57] ABSTRACT

The machine comprises a yarn guide for axially guiding the yarn on the receiving cross bobbin, for each wound off yarn at least one yarn watcher, a cutting device for cutting through the yarn, a yarn tensioner and a joining device for joining yarn ends, where a yarn monitor with a method of controlling is provided for controlling and correcting the assembled yarn bundle and rewinding the cross bobbin, a gripper device for gripping the yarn ends on the cross bobbin, a gripper device for inserting each yarn into the joining device, a gripper device for receiving and holding the yarn ends, a wind-off eye for the shared winding-off of the assembled yarns installed above the yarn joining devices, and a method of control for these devices, where the method of control are separately controlled.

5 Claims, 2 Drawing Sheets

27
41
31
26
30
32
33
36
25
35
24
23
22
34
15
15'
16
37
21
21'
14
14'
13
13'
7
8
12
12'
17
11
11'
10
10'
18
9
9'
20
19
6
6'
7'
8'
2A
2
2'
2B
1
1
42
42
3
4
5
4
3

AUTOMATIC ASSEMBLY MACHINE FOR YARNS

BACKGROUND OF THE INVENTION

1. Field of the Invention

The invention is for an automatic assembly machine for the simultaneous cleaning and assembling of at least two parallel yarns to be wound crosswise on a bobbin.

2. Brief Description of the Prior Art

A machine is known from patent DE-38 08 957 which makes use of a yarn drum to move the yarn assembly to be wound axially back and forth along the bobbin, a shared yarn tensioner for the yarns being assembled and a shared joining device for the simultaneous connection of two yarns from the cross bobbin to two yarns coming from the supply reels.

A disadvantage of this machine is that one of the yarns sometimes escapes from the guiding groove of the yarn reel while the other yarn stays in the guiding groove. As a result only one yarn is wound in a spiral line of a certain pitch for a period of time, while the escaped yarn is wound up without being axially displaced. In doing so the escaped yarn is wound with a shorter length than the other yarn which has not escaped. A difference in length between the two unwound yarns can also arise as a result of a difference in yarn tension in both yarns during the assembly process. Another disadvantage is that the parallel yarns in aforesaid machine are cut through simultaneously in order to increase the likelihood of the yarn ends on the cross bobbin being removed as a unit from the cross bobbin for joining there is, however, still a chance that both yarn ends are not taken up simultaneously and that when the cross bobbin is unwound one yarn end is picked up first and the second yarn end is picked up one or more revolutions later. This results in a difference in length between the two yarns equal to one or more times the circumference of the cross bobbin. When the yarns are subsequently twisted loops will be easily created in the longest yarn, resulting in yarn breakage or defects in the twisted yarns. To compensate for these disadvantages an automatic assembly machine has been realized in accordance with the invention.

SUMMARY OF THE INVENTION

By making use of a yarn guide for winding the yarns onto the cross bobbin the yarns are also wound up together along the same spiral line. Moreover by using a separate yarn watcher, cutting devices, yarn tensioners and joining devices for each yarn being wound off, and a shared yarn monitor, gripper, running eye and control device for the whole assembly, both yarns in the yarn assembly stay separate so that possible differences in length between both yarns are prevented, yarn tension in the yarns is kept constant, and no loops are formed in the yarns later on in the twisting process. The additional use of the yarn monitor and the separate driving of the yarn monitor and the gripper has the advantage that any defective extraction of the yarn is efficiently detected and thus corrected before the joining cycle for the yarns to be joined is started. This is particularly important when the yarns are going to be subjected to frequent cleaning such as is the case when handling spinning bobbins, so that no cycle time is wasted. The result is a machine for the fully automatic cleaning and assembling of two yarns, without any disadvantageous effect on the quality or on the efficiency of the subsequent twist process. Moreover spinning bobbins can also be used as unwinding bobbins, partly by the separate yarn tensioners, which gives better control over yarn tension, and partly by separate drives for selected elements, which allows cycle times to be kept short, which is important when cleaning spinning bobbins in view of the relatively large number of cleaning operations.

BRIEF DESCRIPTION OF THE INVENTION

In the following a more detailed description is given of a preferred but by no means limited embodiment of the automatic assembly in accordance with the invention. This description refers to the attached drawings, where:

DESCRIPTION OF THE PREFERRED EMBODIMENT

Figure 1:
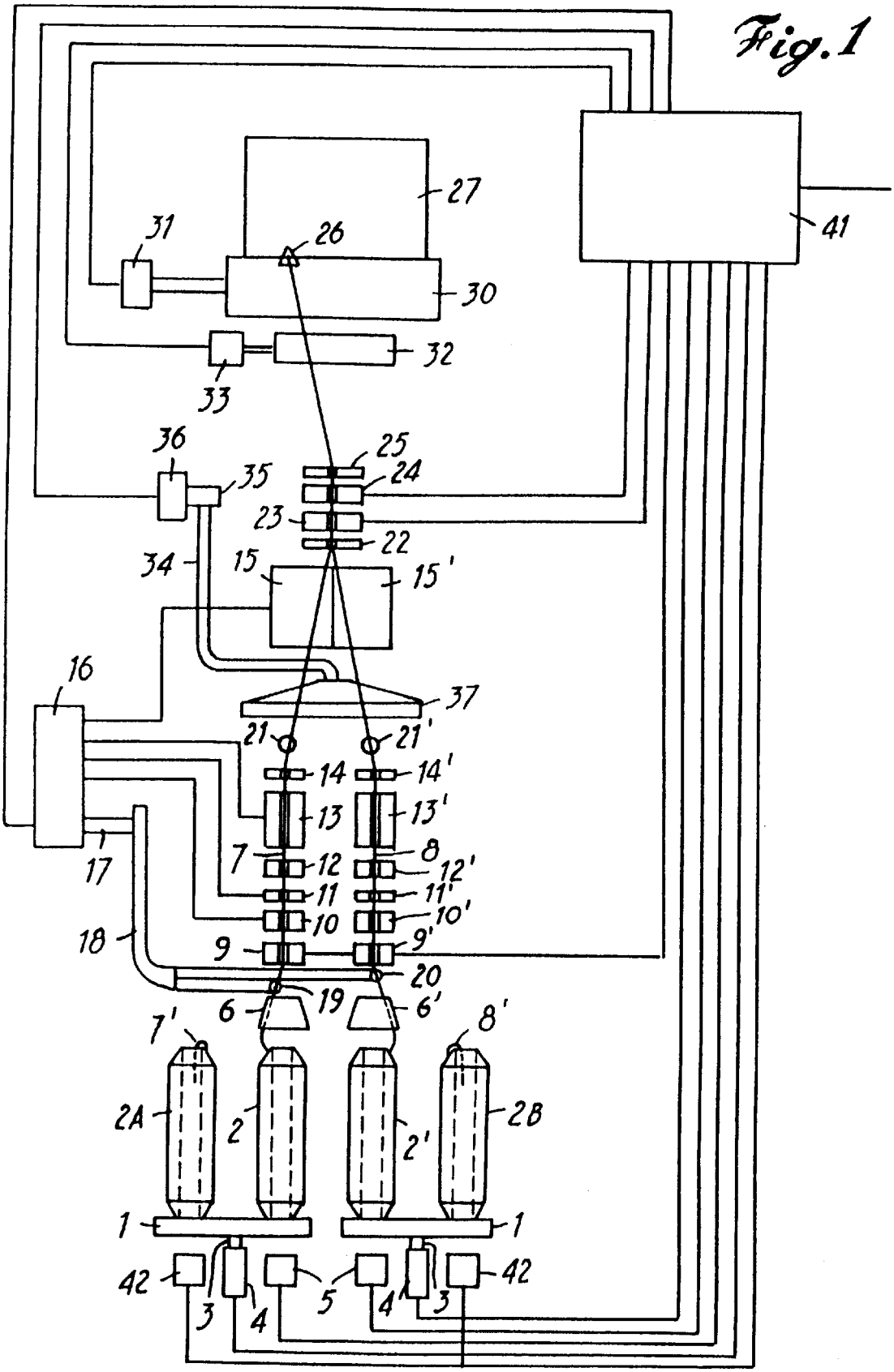
FIG. 1 is a schematic diagram of the front elevation of the machine.
Figure 2:
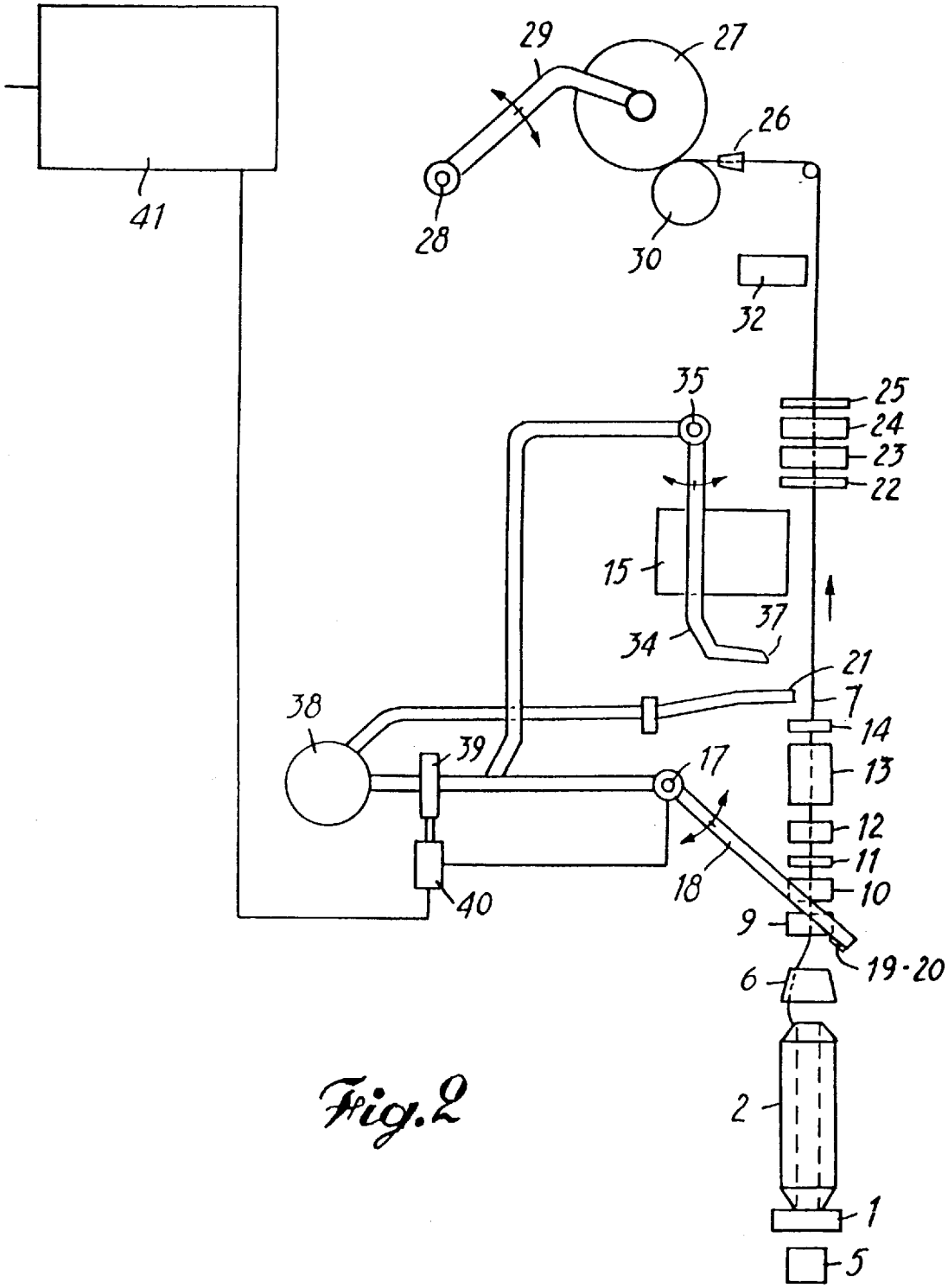
FIG. 2 is a side elevation of the machine.

In these figures two magazines or supports 1 can be seen which each contain a run-off bobbin 2 or 2' respectively and a reserve run-off bobbin 2A or 2B respectively and where each support can turn in a horizontal plane around a spindle 3 by means of a drive 4. Under the casing of each run-off bobbin is a blower device 5 which serves to blow the end of the yarn 7' or 8' respectively hanging free in the casing into the bubble breaker 6 or 6' mounted above each run-off bobbin. Each yarn 7 or 8 is passed separately through a yarn watcher 9 or 9', a cutting device 10 or 10' an adjustable eye 11 or 11', a yarn guide 12 or 12', a yarn tensioner 13 or 13', a yarn guide 14 or 14', and joining device 15 or 15'. Provided between the bubble breakers 6 and 6' and the joining devices 15 and 15' is a suction tube 18 which swivels around an axle 17 by means of a drive 16 and with a suction intake 19–20 for each yarn, where the suction tube can be swivelled in such a way that its suction intakes can carry the extracted yarns 7–8 into the joining devices 15 and 15'. A suction tube 21 and 21' is provided for each yarn for collecting the yarn ends. The yarns run from the joining devices 15 and 15' together into an shared assembly eye 22 and carried together through a yarn cleaner 23, a cutting device 24 and a wind-off eye 25, from where the assembled yarns run to a yarn guide 26 which moves the yarns axially back and forth along the cross bobbin 27 being wound and which is suspended in a swivel arm 29 which swivels around a spindle 28. The joining devices 15 and 15' are set up between the assembly eye 22 and suction tubes 21–21'. The cross bobbin is made to rotate by drive roller 30 with drive 31. A yarn monitor 32 with means of control 33 is installed between the run-off eye 25 and the yarn guide 26 in order to check whether both yarns 7–8 are extracted jointly or in phase from the cross bobbin 27. A suction tube 34 is installed so that it can swivel round spindle 35 with means of control 36 has a suction intake 37 capable of feeding the yarns sucked off the yarns into the yarn monitor 32. The suction tubes 18–21–34 are connected to a vacuum device 38, where the pipe of suction tubes 18–34 is provided with a valve 39 with means of control 40. A control device 41 is provided to control the whole.

The functioning of the assembly machine is described below. During the assembly process the yarns 7–8 are unwound from the run-off bobbins 2 and 2'. Each yarn 7 and 8 then passes through bubble breakers 6 and 6' respectively, yarn watcher 9 and 9', which check for the presence of yarns 7 and 8 and which depending on the presence or absence of the yarn give a suitable signal to control device 41, cutting devices 10 and 10' whose function is explained below, adjustable eyes 11 and 11' in which excessive yarn thickenings are stopped in order to prevent damage to the part further along in the machine, fixed yarn guides 12 and 12', yarn tensioners 13 and 13', fixed yarn guides 14 and 14', suction tubes 21 and 21' whose funtion is described below, assembly eye 22, which is a fixed yarn guide where the yarns 7–8 come together and form the assembled yarn bundle, the yarn cleaner 23 which checks the quality of the assembled bundle and sends a suitable signal in relation so same to control device 41, the cutting device 24, which cuts off the assembled yarn bundle on the instructions of control device 41, and the wind-off eye 25 from where the asembled yarn bundle is guided to a yarn guide 26 which can be displaced axially with respect to the cross bobbin 27, before being wound onto the cross bobbin. When the yarn cleaner 23 detects a defect in the assembled yarn bundle the yarn cleaner 23 sends a signal to the control device 41. The cutting device 24 acting on the instructions of this control device 41 cuts the assembled yarn bundle through and the roller 30 and the yarn guide 26 stops the winding process, where, however, the cut-off end of the assembled yarn bundle continues to be wound up on the cross bobbin 27. The cut ends of the two individual yarns 7–8 are sucked into suction tubes 21 and 21' respectively, which are connected to the vacuum installation 38. The control device 41 then instructs the means of control 36 to swivel suction tube 34 round the spindle 35 until the suction intake 37 of the suction tube 34 is close to the circumference of the cross bobbin 27. The control device then instructs the means of control 40 to open valve 39, as a result of which the suction intake 37 is connected to the vacuum installation 38. At the same time an instruction is given to the drive 31 of the winding device to drive the drive roller 38 in the opposite direction. As a result the cross bobbin 27 unwinds and the assembled yarn bundle is sucked up by suction intake 37 of the suction tube 34. Thereafter the control device 41 instructs the means of control 36 to make the suction tube 34 with suction intake 37 swivel back to its initial position. In the meantime winding continues to proceed and the asembled yarn bundle is sucked further by the suction intake 37. The downward swivel movement results in the assembled yarn bundle being positioned in yarn monitor 32, in the yarn cleaner 29 and in the joining devices 15 and 15'. First the yarn cleaner 23 checks whether there are really two yarns in the assembled yarn bundle which has been sucked up. If this is not the case the control device 41 causes the assembled yarn bundle to be cut through by the cutting device 24 and stops the unwinding of the cross bobbin. The control device 41 then causes the suction intake 37 and the winding device to start a new suction cycle. This can be repeated several times until the yarn detector 23 does in fact find that two yarns are being unwound from the cross bobbin 27. The yarn monitor 32 then checks that the two yarns are in phase or are being drawn together from the cross bobbin 27 and unwound. It is after all quite possible that the suction intake 37 first sucks one yarn from the cross bobbin and only sucks the other yarn up after one or more revolutions of the cross bobbin. If the yarn monitor 32 detects that they are not sucking in phase, a suitable signal is sent to the control device 41. This in turn transmits the necessary instructions to the drive 31 and the driver roller 30, to the means of control 36 of the suction tube 34 with suction intake 37, to the means of control of the cutting device in the yarn monitor 32 and to the means of control 40 of valve 39 to tell them to remove the lack of phase entirely automatically. Once the assembled yard bundle is being correctly extracted, the joining devices 15 and 15' will split the two extracted yarns. The sensors in said joining devices give a signal to the control device 41 when this split has taken place. The control device 41 then gives an instruction to the drive 16 to complete the rest of the cycle, whereby the cutting devices 10 and 10' complete the cycle, cut the yarns 7 and 8 and the suction tubes 21 and 21' take up the upper yarn ends. In order to make this possible drive 16 opens the adjustable eyes 11 and 11' and the yarn tensioners 13 and 13'. The drive 16 then also swivels the suction intakes 19 and 20 of the suction tube 18 to close to the bubble breakers 6 and 6'. As the suction tube 18, like suction tube 34, is connected via valve 39 to the vacuuum installation 38, the cut yarn ends which still form part of the run-off bobbins 2 and 2' are sucked up by suction tube 18. The drive 16 moves the suction tube 18 to its highest position between the joining devices 15 and 15' and the assembly eye 22, as a result of which the yarn ends 7' and 8' are suitably positioned-in the yarn watchers 9 and 9', cutting devices 10 and 10' adjustable eyes 11 and 11', the yarn guides 12 and 12', yarn tensioners 13 and 13', yarn guides 14 and 14' and the connection devices 15 and 15'. The drive 16 then again shuts the adjustable eyes 11 and 11' and the yarn tensioners 13 and 13'. Thereafter the drive 16 actuates the joining devices 15 and 15' causing yarn end 7' to be connected to a yarn from the split yarn bundle and yarn end 8' to be connected to an other yarn from the split yarn bundle. Finally the drive 16 returns the suction pipe 18 to its inital position, after which the control device 41 instructs the drive 31 of the winding device to resume the winding process.

The fact that the means of control 36 of the suction pipe 34, the means of control 40 of the valve 39 and the means of control 33 of the cutting device of the yarn monitor 32 can be driectly controlled by the control device 41, ensures that no cycle time is lost unnecessarily. The drive 16 is only activated when the previous steps have been successfully completed. Moreover each of the previous intermediate steps can be repeated if necessary until they have been succesfully completed and only then is the next intermediate step initiated.

Yarn watchers 9 and 9' check the presence of running yarn during the winding process. If one of the two detects the absence of yarn as the result of breakage or the exhaustion of the run-off bobbins 2 and 2' respectively, they send a signal to the control device 41 which in turn activates the cutting device 24. The cycle described above, however, starts before cutting devices 10 and 10' are activated whereby the control device 41 activates the relevant drives 4 or 4', as a result of which the empty run-off bobbin or run-off bobbin with broken yarn end is replaced by reserve run-off bobbins 2A and 2B. These reserve run-off bobbins 2A and 2B must by preference be prepared by undoing yarn ends 7' and 8' and allowing them to hang loose in the bobbin casing. This can be done both automatically and manually. In the latter case a suction device 42 may be useful. After the empty run-off bobbin or run-off bobbin with broken yarn is replaced by a reserve run-off bobbin 2A or 2B, the control device 41 instructs the blower device 5 to blow the yarn end hanging loose in the casing of the supply bobbin through the bubble breakers 6 and 6', above which it is sucked up by the suction tube 18 via its suction intakes 19–20. The remainder of the cycle proceeds as described above.

It goes without saying that the shape and dimensions as well as the respective positioning of certain of the components described above may differ from one another and that certain of these parts could be replaced by others which serve the same purpose. For example use could be made of two magazines containing several run-off bobbins or of one magazine with one or more reserve run-off bobbins from which a reserve bobbin is taken in order to replace an empty run-off bobbin or a run-off bobbin with a broken yarn end. Reserve run-off bobbins could be fitted manually in a magazine but also automatically and empty run-off bobbins could be removed manually or automatically.

Use could also be made of a separate yarn cleaner for each yarn 7 and 8 individually. To this end a cleaner could for example be fitted above the suction tubes 21 and 21', with or without its own cutting device.

We claim:

1. Automatic assembly machine for yarns where at least two yarns are wound in parallel or in phase crosswise from at least two run-off bobbins onto a cross bobbin, comprising:

(a) joining means equipped for joining by means of winding together or splicing the yarn ends of the cross bobbin with that of the run-off bobbins, said joining means equipped to loin by means of winding together or splicing one yarn end of the cross bobbin with the yarn end of one of the run-off bobbins and the second yarn end of the cross bobbin with the yarn end of a second run-off bobbin, (b) a yarn guide for axially guiding the yarn on the receiving cross bobbin, (c) at least one yarn watcher for each yarn, (d) a yarn tensioner for maintaining said yarns under tension, (e) a yarn monitor disposed between the cross bobbin and a wind-off eye having means for controlling and correcting the assembled yarn bundle and rewinding the cross bobbin and for controlling gripping of the two yarn ends of the cross bobbin in phase and to automatically correct a not in phase condition into an in phase condition of the yarns to be joined, (f) gripper means for gripping the yarn ends on the cross bobbin, for inserting each yarn into the joining means, and for receiving and holding the yarn ends, (g) said wind-off eye for the shared winding-off of the assembled yarns installed above the yarn joining means, (h) a yarn cleaner for detecting spinning defects in the assembled yarn bundle, (i) a cutting device for cutting through the assembled yarn bundle, and (j) means for controlling said joining and cutting devices and for controlling individually the yarn monitor and the gripper means.

2. Automatic assembly machine in accordance with claim 1, wherein the gripper device comprises a suction tube with a valve, a means of control for the swivelling of the suction tube and a vacuum installation for extracting the yarns.

3. Automatic assembly machine in accordance with claim 2, wherein the means of control of the swivelling suction tube also controls the valve of the suction tube.

4. Automatic assembly machine in accordance with claim 1, wherein the gripper means comprises suction tubes and a valve with means to control the suction tubes.

5. Automatic assembly machine in accordance with claim 1, wherein a yarn cleaner is provided for each yarn.

* * * * *